United States Patent [19]

Stone

[11] 4,314,490

[45] Feb. 9, 1982

[54] TORQUE WRENCH WITH ALARM INDICATOR

[76] Inventor: Gregory M. Stone, 11200 Powderhorn, Boise, Id. 83704

[21] Appl. No.: 164,778

[22] Filed: Jun. 30, 1980

[51] Int. Cl.[3] ..... B25B 23/142

[52] U.S. Cl. ..... 81/479; 81/477; 73/862.23

[58] Field of Search ..... 81/479, 483, 477; 73/862.23, 862.21; 340/688, 665, 540

[56] References Cited

U.S. PATENT DOCUMENTS

| | | | |
|---|---|---|---|
| 2,682,796 | 7/1954 | Larson | 73/862.23 |
| 2,771,597 | 11/1956 | Freedman | 340/688 |
| 2,792,734 | 5/1957 | Larson et al. | 81/477 |
| 2,867,698 | 1/1959 | Gondolfo | 340/688 |
| 3,142,177 | 7/1964 | Hanscom et al. | 73/862.23 |
| 3,304,771 | 2/1967 | Ochs | 73/862.23 |
| 4,195,589 | 4/1980 | Blattner | 73/862.23 |

*Primary Examiner*—James L. Jones, Jr.
*Attorney, Agent, or Firm*—A. C. Smith

[57] ABSTRACT

A torque wrench is provided in which a removably attached alarm indicator produces an audible buzzing or visual indication when a pre-selected torque is applied by the torque wrench. In a preferred embodiment, an audible buzzer has a magnet in its base to facilitate removable attachment to a faceplate on the wrench, and also to make possible the use of the same audible buzzer on other torque wrenches. The audible buzzer may include an electrical circuit having a switch, battery, and buzzer all connected in series.

2 Claims, 3 Drawing Figures

TORQUE WRENCH WITH ALARM INDICATOR

BACKGROUND OF THE INVENTION

A common requirement in mechanical systems is the ability to tighten a bolt with a known torque. A typical example is the tightening of "head bolts" on an automobile engine, an event which occurs many times a day in auto repair facilities.

In the prior art, the torque is applied with a special wrench known as a "torque wrench". To apply the desired torque, the operator must watch the movement of a pointer against a calibrated faceplate on the wrench during tightening. A difficulty with this device is that direct observation of the wrench faceplate is difficult or impossible in many situations. A solution to this problem is achieved in the prior art by the use of a mechanically similar ratchet-like structure which sounds an audible "click" when a preset torque value is attained.

However, torque wrenches of this type are very expensive, relative to standard type torque wrenches.

SUMMARY OF THE INVENTION

In accordance with the illustrated preferred embodiments, the present invention provides a standard torque wrench with an alarm indicator such as an audible buzzer which is removably attached to the faceplate of the wrench, e.g., by a magnet. The audible buzzer can therefore be removed and used with any standard torque wrench faceplate. In a preferred embodiment, the audible buzzer contains a series circuit including a battery, a buzzer, and a switch or conductive strip extending from the unit's housing. The audible buzzer is positioned on the wrench faceplate with the switch or conductive strip located at a preset torque calibration mark. When the applied torque reaches the preset value, the pointer of the wrench comes into physical contact with the switch, or conductive strip, thereby activating the audible buzzer.

DETAILED DESCRIPTION OF THE INVENTION

Figure 1:
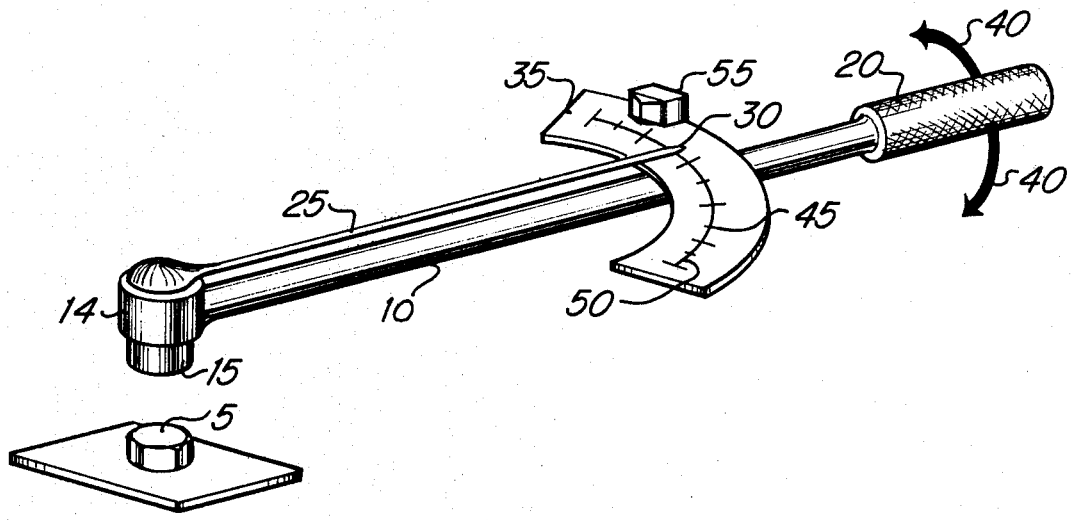
FIG. 1 illustrates a preferred embodiment of a torque wrench according to the invention.

FIG. 1 shows the head of a bolt 5 to be tightened with a known torque. This torque is applied to bolt head 5 by a torque wrench including a mechanical arm 10 about 18 inches long and about ½ inch in diameter, preferably of resilient steel. Arm 10 terminates at one end in a grip area 20 and terminates at the other end in a head 14 which receives a socket 15 suitable for engaging bolt head 5 in a conventional manner. Pointer arm 25, preferably of rigid metal construction, is attached to mechanical arm 10 at the head end 14. Pointer arm 25 extends the length of mechanical arm 10, terminating in a tapered point 30 which is disposed above a platform or faceplate 35 that is attached to mechanical arm 10 in the vicinity of grip area 20. Faceplate 35 is located in the plane of motion of the torque wrench when it is operated to tighten bolt 5, as generally indicated by the arrows 40. Faceplate 35 in a preferred embodiment is of a material capable of magnetic attraction, such as iron or steel.

In a preferred embodiment, a line 50 is etched onto faceplate 35 along an arc of constant radius equal to the length of pointer arm 25, measured from the axis of rotation of the wrench through socket 15. Torque calibration marks 45 on faceplate 35 intersect line 50. When a force is applied to grip area 20 in plane 40, flexion of mechanical arm 10 causes a displacement of faceplate 35 attached thereto, relative to pointer arm 25, the amount of displacement being in proportion to the applied torque. Pointer arm tip 30 will therefore be located above a particular torque calibration mark 45 whose value corresponds to the applied torque. It is evident that the proper use of such a torque wrench is limited to situations in which the operator can visually monitor the calibrations on faceplate 35. This limitation is obviated by the present invention in which an audible indicator is used to provide an audible signal when the desired torque has been reached.

Figure 2:
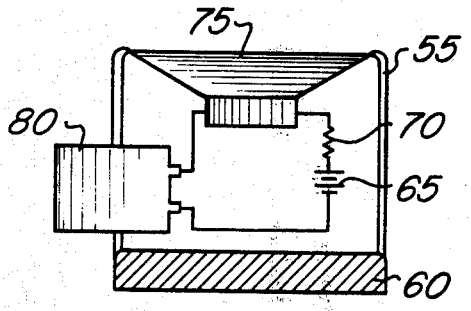
FIG. 2 shows a sectioned view of a removably attachable buzzer used in a preferred embodiment of the invention.

FIG. 2 shows a preferred embodiment of an audible indicator in which an electrically non-conductive housing 35, e.g., of plastic contains a buzzer circuit designed to produce an audible signal when triggered. Such a circuit may include a series electrical circuit with a battery 65 connected in series with resistor 70, a buzzer 75, and a microswitch 80 which protrudes from the housing 55. The value of resistor 70 is chosen to properly adjust the current supplied to buzzer 75 for adequate audible level. Alternatively, a visual indicator or light may be connected in place of the buzzer to provide a visual alarm either in lieu of, or in addition to the audible alarm provided by buzzer 75.

Figure 3:
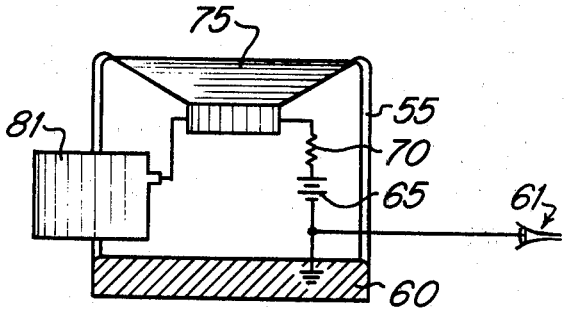
FIG. 3 shows a sectioned view of a buzzer used in another embodiment of the invention.

In the preferred embodiment, audible indicator housing 55 contains a magnet 60 at its base to facilitate removable attachement of audible buzzer housing 55 to wrench 35. Housing 55 may alternatively be removably attached to faceplate 35 without the use of magnets, for example by using clamps or set screws. However, it is an advantage of the illustrated embodiment that the audible indicator can be attached by its magnet 60 to faceplate 35 of many commercially available torque wrenches having platforms or gage plates capable of magnetic attraction without regard to the detailed structure thereof. Alternatively, the buzzer circuit may be arranged and mounted on the faceplate 35 in electrically conductive relationship therewith, as shown in FIG. 3. In this embodiment, pointer arm 30 may complete the series circuit as it contacts an exposed connection 81 positioned in place of switch 80. In this case, the negative side of battery 65 is electrically connected to a conductive magnet 60 or to optional alligator clip 61 which may be clipped onto the wrench to make electrical contact therewith.

In operation, an operator positions audible housing 55 at a desired torque calibration mark 45 along line 50. In this position, microswitch 80 rests in the path of pointer arm tip 30 at the desired torque calibration mark 45. When the preselected torque is applied, pointer tip 30 touches and closes microswitch 80 which, in turn, closes the circuit producing an audible buzzer signal. Where an exposed connection 81 is used in place of microswitch 80, the electrical circuit is completed through the pointer arm 30 which contacts it when the selected torque limit is reached. The circuit is then completed through the wrench and the conductive magnet on faceplate 35, thereby sounding the audible alarm.

I claim:

1. A torque wrench comprising:

a mechanical arm having at one end a grip area adapted for the manual application of force to produce torque;

a faceplate affixed to said mechanical arm in the vicinity of said grip for displaying torque calibration marks, said faceplate including a material capable of magnetic attraction;

a pointer arm disposed on said mechanical arm to provide relative motion between said pointer arm and said faceplate affixed to said mechanical arm proportional to said torque; and alarm means including a magnet for removable magnetic attachment to said faceplate near a selected calibration mark thereon for producing an alarm indication when said pointer arm is coincident with a preselected calibration mark, said alarm means including a battery, an alarm indicator and switch means electrically interconnected to activate said indicator upon contact of said switch means by said pointer.

2. A torque wrench as in claim 1 wherein:

said battery is in electrical contact with said faceplate;

said faceplate is in electrical contact with said pointer; and said switch means includes an electrical contact to form a closed electrical circuit upon contact with said pointer to activate said indicator.

* * * * *